US010125951B2

(12) United States Patent
Nakamura

(10) Patent No.: US 10,125,951 B2
(45) Date of Patent: Nov. 13, 2018

(54) LIGHT FLUX CONTROL MEMBER, LIGHT-EMITTING DEVICE AND LIGHTING DEVICE

(71) Applicant: Enplas Corporation, Saitama (JP)

(72) Inventor: Masato Nakamura, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 122 days.

(21) Appl. No.: 15/326,165

(22) PCT Filed: Jun. 24, 2015

(86) PCT No.: PCT/JP2015/068112
§ 371 (c)(1),
(2) Date: Jan. 13, 2017

(87) PCT Pub. No.: WO2016/009798
PCT Pub. Date: Jan. 21, 2016

(65) Prior Publication Data

US 2017/0198884 A1 Jul. 13, 2017

(30) Foreign Application Priority Data

Jul. 14, 2014 (JP) ..... 2014-144066

(51) Int. Cl.
*F21V 5/04* (2006.01)
*F21V 13/04* (2006.01)
(Continued)

(52) U.S. Cl.
CPC ..... *F21V 13/04* (2013.01); *F21K 9/232* (2016.08); *F21K 9/237* (2016.08); *F21V 3/02* (2013.01);
(Continued)

(58) Field of Classification Search
CPC ..... F21K 9/232; F21K 9/237; F21V 13/04; F21V 3/02; F21V 5/045; F21V 7/04;
(Continued)

(56) References Cited

U.S. PATENT DOCUMENTS 8,425,076 B2 * 4/2013 Lockwood ..... B64F 1/20 362/153.1
9,377,180 B2 * 6/2016 Nakamura ..... F21V 13/04

FOREIGN PATENT DOCUMENTS

JP 2013-084346 A 5/2013
JP 2013-140318 A 7/2013
(Continued)

OTHER PUBLICATIONS

International Search Report from International Application No. PCT/JP2015/068112 dated Sep. 8, 2015.

*Primary Examiner* — Peggy Neils
(74) *Attorney, Agent, or Firm* — Brundidge & Stanger, P.C.

(57) ABSTRACT

This light flux control member comprises a first (second) light flux control member. The first light flux control member comprises an entry region including a Fresnel lens portion and an entry surface; an exit surface; and a reflective surface. The reflective surface is a rotationally symmetric surface with the central axis of the first light flux control member as the rotation axis. The reflective surface is formed such that the generatrix of the reflective surface is a concave curve relative to the entry surface and the outer peripheral portion of the reflective surface is distanced farther from an orthogonal plane compared to the inner peripheral portion thereof in a direction that follows an optical axis, which is the center of the total light flux of at least one light-emitting element, said orthogonal plane passing through an arbitrary point on the entry surface and being orthogonal to the optical axis.

18 Claims, 10 Drawing Sheets

(51) Int. Cl.

| | |
|---|---|
| ***F21V 7/04*** | (2006.01) |
| ***F21V 3/02*** | (2006.01) |
| ***F21K 9/232*** | (2016.01) |
| ***F21K 9/237*** | (2016.01) |
| *F21Y 115/10* | (2016.01) |

(52) U.S. Cl.
CPC ..... *F21V 5/045* (2013.01); *F21V 7/04* (2013.01); *F21Y 2115/10* (2016.08)

(58) Field of Classification Search
CPC ... F21V 13/00; F21V 3/00; F21V 5/04; F21Y 2115/10
See application file for complete search history.

(56) References Cited

FOREIGN PATENT DOCUMENTS

| | | | |
|---|---|---|---|
| JP | 2014-103062 | A | 6/2014 |
| WO | 2013/118448 | A1 | 8/2013 |
| WO | 2014/041745 | A1 | 3/2014 |
| WO | 2014/054226 | A1 | 4/2014 |

* cited by examiner

LIGHT FLUX CONTROL MEMBER, LIGHT-EMITTING DEVICE AND LIGHTING DEVICE

TECHNICAL FIELD

The present invention relates to a light flux controlling member that controls a distribution of light emitted from at least one light-emitting element, and a light-emitting device and an illumination device which include the light flux controlling member.

BACKGROUND ART

In recent years, as an illumination device that replaces incandescent lamps, an illumination device (for example, a light-emitting diode (hereinafter also referred to as "LED") bulb) using a LED as a light source has been developed in view of energy saving, environmental conservation and the like. However, in comparison with light emitted from incandescent lamp, light emitted from an LED has high rectilinearity. Therefore, to use an LED bulb in the same manner as incandescent lamps, it is important to distribute the light emitted from the LED to the forward direction, the lateral direction and the rearward direction with a good balance.

As such an illumination device, an illumination device is known which has a plurality of LED modules, and a lens for controlling the light distribution of the light emitted from the LED modules (see, for example, PTL 1), for example. FIG. 1 is a perspective view of LED module 10 and lens 20 disclosed in PTL 1. The illumination device disclosed in PTL 1 includes a substrate not illustrated, seven LED modules 10 disposed on the substrate, and annular lens 20 disposed on the upper side of seven LED modules 10. One of LED modules 10 is disposed on the central axis of lens 20, and the remaining six LED modules 10 are disposed in an annular form around the LED module 10 disposed on the central axis of lens 20. Lens 20 includes incidence surface 21 on which light emitted from LED module 10 is incident, and emission surface 22 configured to emit the incident light. Incidence surface 21 is disposed to face LED module 10 in annular lens 20. Emission surface 22 is disposed on the outer side in annular lens 20. Lens 20 allows incidence of a part of light emitted from LED module 10 on incidence surface 21, and emits the light from emission surface 22 in the forward direction, the lateral direction and the rearward direction. In addition, annular lens 20 allows another part of the light emitted from LED module 10 to pass therethrough via a hollow part in the forward direction. As described, the illumination device disclosed in PTL 1 can distribute the light emitted from LED module 10 in the forward direction, the lateral direction and the rearward direction.

CITATION LIST

Patent Literature

PTL 1
Japanese Patent Application Laid-Open No. 2013-84346

SUMMARY OF INVENTION

Technical Problem

In the illumination device disclosed in PTL 1, a part of the light emitted from LED module 10 (light emitting element) disposed at the center is also incident on incidence surface

21 of lens 20 (light flux controlling member). In lens 20 disclosed in PTL 1, however, while the light distribution of the light emitted from LED modules 10 disposed around LED module 10 at the center can be appropriately controlled, the distribution of the incident light from LED module 10 disposed at the center cannot be appropriately controlled. Consequently, the illumination device disclosed in PTL 1 cannot distribute the light emitted from the light emitting element disposed on the central axis of the light flux controlling member to the forward direction, the lateral direction and the rearward direction with a good balance.

An object of the present invention is to provide a light flux controlling member which can appropriately control the light distribution of the light emitted from at least one light emitting element even in the case where a light emitting element is disposed on the central axis thereof. In addition, another object of the present invention is to provide a light-emitting device and an illumination device which include the above-mentioned light flux controlling member.

Solution to Problem

A light flux controlling member according to an embodiment of the present invention is configured to control a distribution of light emitted from at least one light emitting element, the light flux controlling member including: a first light flux controlling member including an incidence region on which light emitted from the light emitting element is incident, the incidence region including a fresnel lens part disposed to surround a central axis of the first light flux controlling member and an incidence surface disposed on an outside of the fresnel lens part, an emission surface from which a part of light incident on the incidence region is emitted, the emission surface being disposed on a side opposite to the incidence region, and a reflecting surface configured to reflect another part of the incident light, the reflecting surface being disposed on an outside of the emission surface; and a second light flux controlling member including a transmission reflecting surface disposed at a position facing the emission surface and the reflecting surface, the transmission reflecting surface being configured to allow a part of arriving light emitted from the emission surface to pass therethrough while reflecting a remaining part of the arriving light. The reflecting surface is rotationally symmetrical about the central axis of the first light flux controlling member and is formed such that a generatrix of the reflecting surface is a curve recessed with respect to the incidence surface, and that a distance of an outer periphery portion thereof from an orthogonal plane that is orthogonal to an optical axis and passes through an arbitrary point on the incidence surface in a direction along the optical axis is larger than that of an inner periphery portion thereof, the optical axis being a center of a total light flux of the light emitting element, and the transmission reflecting surface is rotationally symmetrical about a central axis of the second light flux controlling member, and is formed such that a generatrix of the transmission reflecting surface is a curve recessed with respect to the first light flux controlling member, and that a distance of an outer periphery portion thereof from the orthogonal plane in the direction along the optical axis is larger than that of a center portion thereof.

A light-emitting device according to an embodiment of the present invention includes: a substrate; at least one light emitting element disposed on the substrate; and the light flux controlling member disposed over the light emitting element. The light emitting element is disposed at a position facing a part of the incidence surface and at least a part of the fresnel lens part.

An illumination device according to an embodiment of the present invention includes: the light-emitting device; a cover configured to cover the light flux controlling member and allow light emitted from the light-emitting device to pass therethrough while diffusing the light; and a housing configured to support the light-emitting device and the cover.

Advantageous Effects of Invention

A light-emitting device and an illumination device including the light flux controlling member according to the embodiment of the present invention can appropriately control the light distribution of the light emitted from at least one light emitting element even in the case where a light emitting element is disposed on the central axis thereof. Therefore, according to the present invention, it is possible to provide an illumination device which can illuminate the room over a wide range as an incandescent lamp by utilizing reflection light from the ceiling or the wall surface.

DESCRIPTION OF EMBODIMENTS

In the following, an embodiment of the present invention is described in detail with reference to the accompanying drawings. The following description explains an illumination device which can be used in place of incandescent lamps, as a typical example of the illumination device of the embodiment of the present invention.

(Configuration of Illumination Device)

Figure 1:
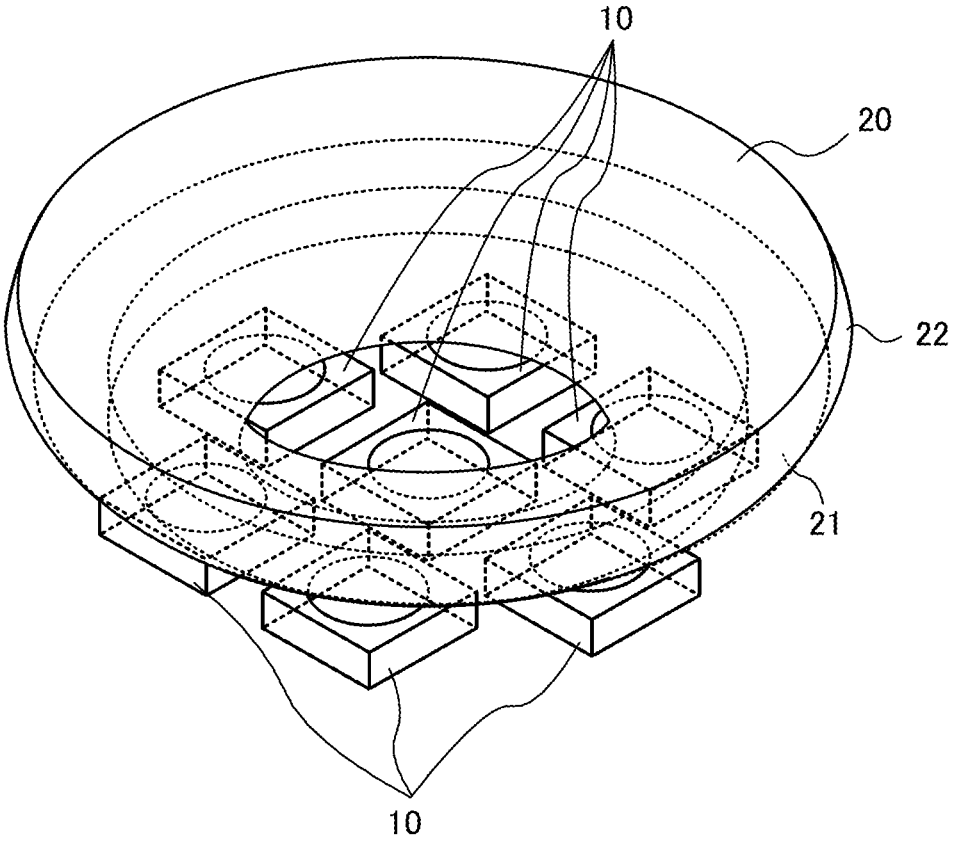
FIG. 1 is a perspective view of an LED module and a lens disclosed in PTL 1.
Figure 2:
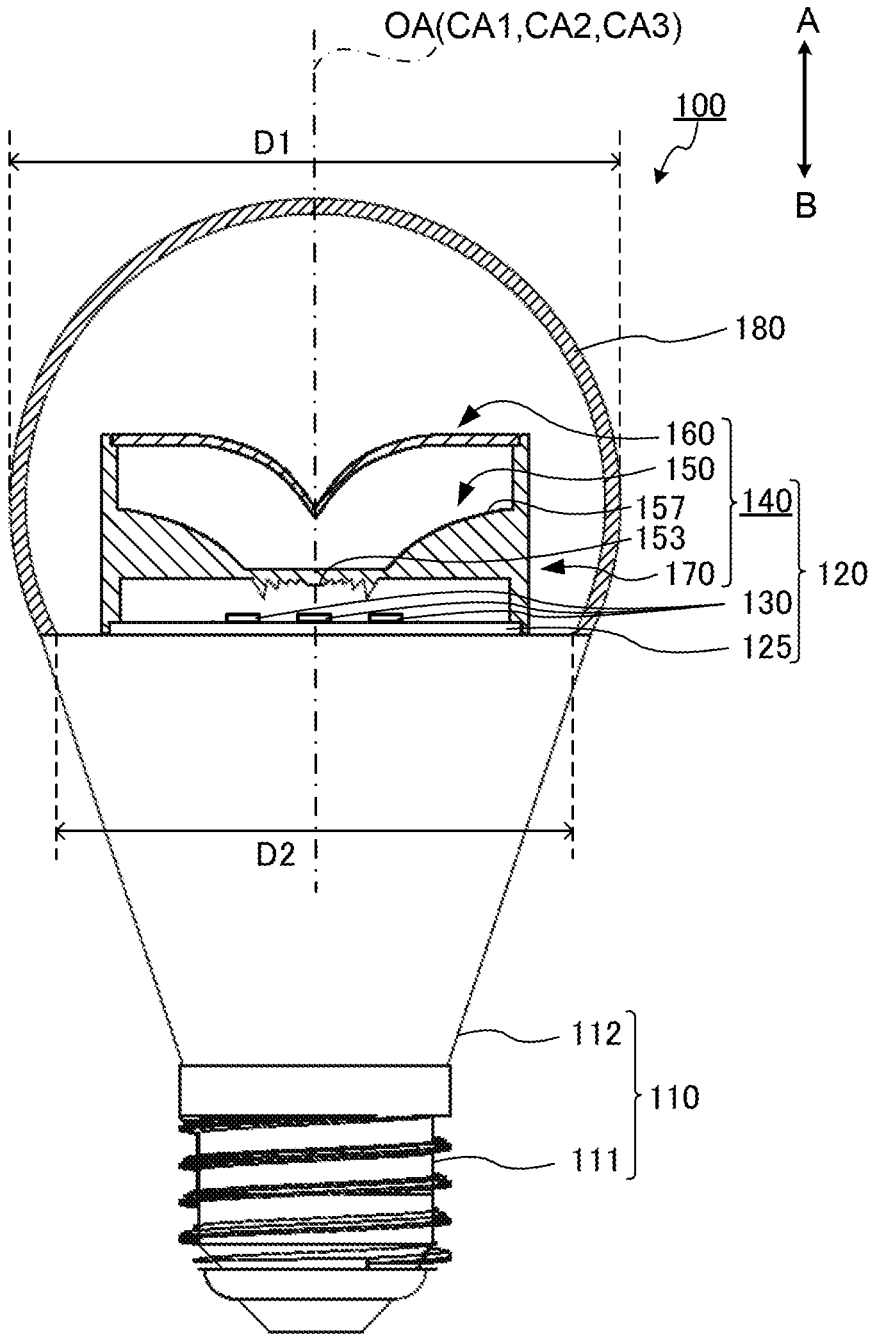
FIG. 2 is a sectional view of a main part of an illumination device according to an embodiment.

FIG. 2 is a sectional view illustrating a configuration of a principal part of illumination device 100 according to the embodiment. As illustrated in FIG. 2, illumination device 100 includes housing 110, light-emitting device 120 and cover 180. The components are described below. In the following description, the "optical axis of a plurality of light emitting elements" is the light travelling direction at the center of a total light flux three-dimensionally emitted from a plurality of light emitting elements 130. In addition, the emission direction along optical axis OA of light emitting element 130 (the A direction illustrated in FIG. 2) is the forward direction, and the direction opposite to the A direction (B direction illustrated in FIG. 2) is the rearward direction.

Housing 110 supports light-emitting device 120 and cover 180 at the front end part of housing 110. As illustrated in FIG. 2, housing 110 includes base 111, and housing main body 112 disposed on the front side of base 111. The shape of housing main body 112 is set in accordance with the light distribution characteristics of light flux controlling member 140. In the present embodiment, housing main body 112 has a truncated cone shape so that light emitted from cover 180 is not blocked.

In housing main body 112, a power source circuit not illustrated that electrically connects base 111 and light emitting element 130 is disposed. In addition, housing main body 112 serves also as a heat sink for emitting the heat of light emitting element 130. In view of this, preferably, housing main body 112 is composed of a metal having a high thermal conductivity. Examples of the material of housing main body 112 include aluminum, copper and the like.

Light-emitting device 120 is mounted in housing 110. Light-emitting device 120 includes substrate 125, a plurality of light emitting elements 130 and light flux controlling member 140.

Figure 3:
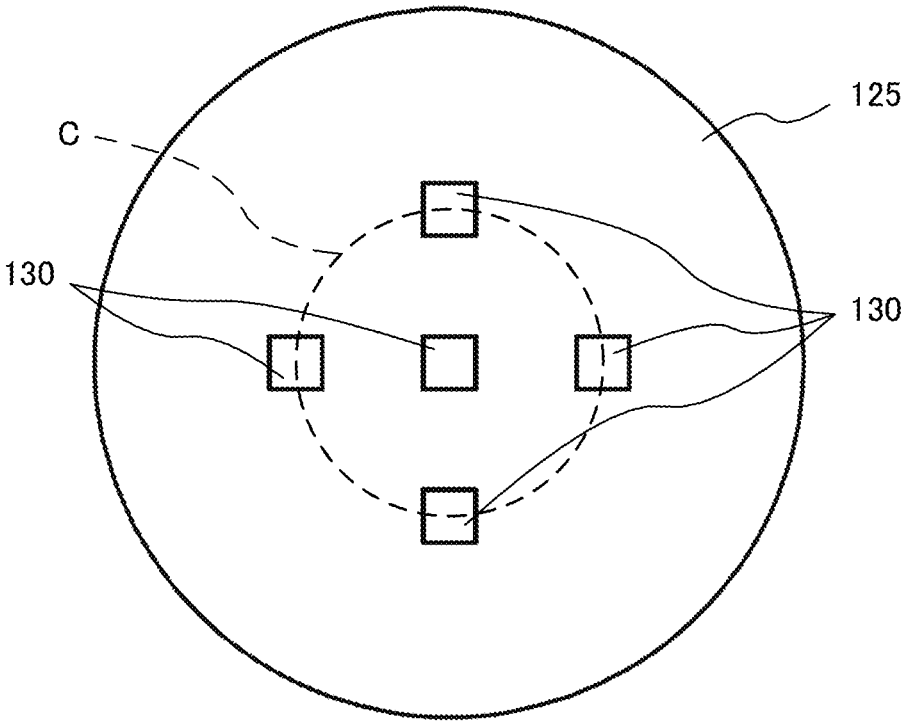
FIG. 3 illustrates installation positions of light emitting elements on a substrate.

Substrate 125 is fixed to housing main body 112. Light emitting elements 130 and light flux controlling member 140 are fixed on one surface of substrate 125. The shape and the size of substrate 125 are not limited, and are appropriately set in accordance with the size of illumination device 100, the number and the size of light emitting element 130 and the like. FIG. 3 is a plan view illustrating substrate 125 and light emitting elements 130. As illustrated in FIG. 3, substrate 125 has a substantially circular shape in plan view. The type of substrate 125 is not limited. Examples of substrate 125 include an aluminum substrate, a glass composite substrate, a glass epoxy substrate and the like.

Light emitting elements 130 are disposed on substrate 125 as the light source of illumination device 100. For example, light-emitting elements 130 are light-emitting diodes (LEDs) such as white light-emitting diodes. The number of light-emitting elements 130 is not limited. In the present embodiment, five light emitting elements 130 are provided. The positions of light emitting elements 130 on substrate 125 are not limited as long as light emitting elements 130 face a part of incidence surface 155 (described later) and at least a part of fresnel lens part 152 (described later). The positions of light emitting elements 130 can be appropriately changed in accordance with the shape and the size of light flux controlling member 140. For example, light emitting elements 130 may be disposed in an annular form, or may be disposed in an array on substrate 125. In the present embodiment, as illustrated in FIG. 3, one light emitting element 130 is disposed at the center of substrate 125, and the remaining four light emitting elements 130 are disposed at even intervals on the outer side of (around) the center. On the assumption that virtual circle C is disposed on substrate 125, the light emitting element 130 disposed at the center of substrate 125 is disposed at the center of virtual circle C, and four light emitting elements 130 disposed on the outside are disposed on the circumference of virtual circle C at even intervals. Here, preferably, at least one of four light emitting elements 130 disposed on the outside is disposed to overlap the internal edge of reflecting surface 157 (described later) as viewed from second light flux controlling member 160 (described later) side. From the viewpoint of further efficiently reflecting the light emitted from light emitting element 130, preferably, optical axis OA of at least one of light emitting elements 130 disposed on the outside overlaps the internal edge of reflecting surface 157, or more preferably, light axes LA of all light emitting elements 130 disposed on the outside overlap the internal edge of reflecting surface 157. In the present embodiment, as viewed from second light flux controlling member 160 side, light axes LA of four light emitting elements 130 disposed on the outside are disposed to overlap the internal edge of reflecting surface 157.

Light flux controlling member 140 controls the light distribution of light emitted from light emitting elements 130. To be more specific, light flux controlling member 140 distributes light emitted from light emitting elements 130 to the forward direction, the lateral direction and the rearward direction with a good balance. Light flux controlling member 140 disposed on substrate 125 in such a manner as to cover light emitting elements 130 (see FIG. 2). Details of light flux controlling member 140 will be described later.

Cover 180 covers light-emitting device 120 and allows light emitted from light-emitting device 120 (light flux controlling member 140) to pass therethrough while diffusing the light. Cover 180 forms a hollow region having an opening part. Light-emitting device 120 is disposed in the hollow region of cover 180. From the viewpoint of emitting light with a good balance, preferably, cover 180 has a shape rotationally symmetrical about optical axis OA of light emitting element 130 disposed at the center of substrate 125, in the plurality of light emitting elements 130. Preferably, cover 180 has a shape which can further improve the balance of the light distribution of light emitted from light-emitting device 120. For example, preferably, cover 180 has a shape in which the diameter of the opening of the cover is smaller than the maximum outer diameter of cover 180 from the viewpoint of increasing the proportion of the emission light in the rearward direction. For example, the shape of cover 180 may be a spherical cap shape (a shape obtained by cutting out a part of a sphere along a plane). Maximum outer diameter D1 of cover 180 is, for example, 60 mm, and opening diameter D2 of cover 180 is, for example, 38 mm (see FIG. 2).

Cover 180 has light transmitting property and light diffusing property. The material of cover 180 is not limited as long as the material has light transmitting property and light diffusing property. Examples of the material of cover 180 include light transmissive resins such as polymethylmethacrylate (PMMA), polycarbonate (PC), and epoxy resin (EP); and glass. The way of giving the light diffusion function to cover 180 is not limited. For example, a light diffusion treatment (for example, roughening treatment) may be performed on the internal surface or the external surface of a cover produced with a transparent material, or a light diffusing material containing a scattering member such as beads may be added to the above-mentioned transparent material.

(Configuration of Light Flux Controlling Member)

Figure 4A:
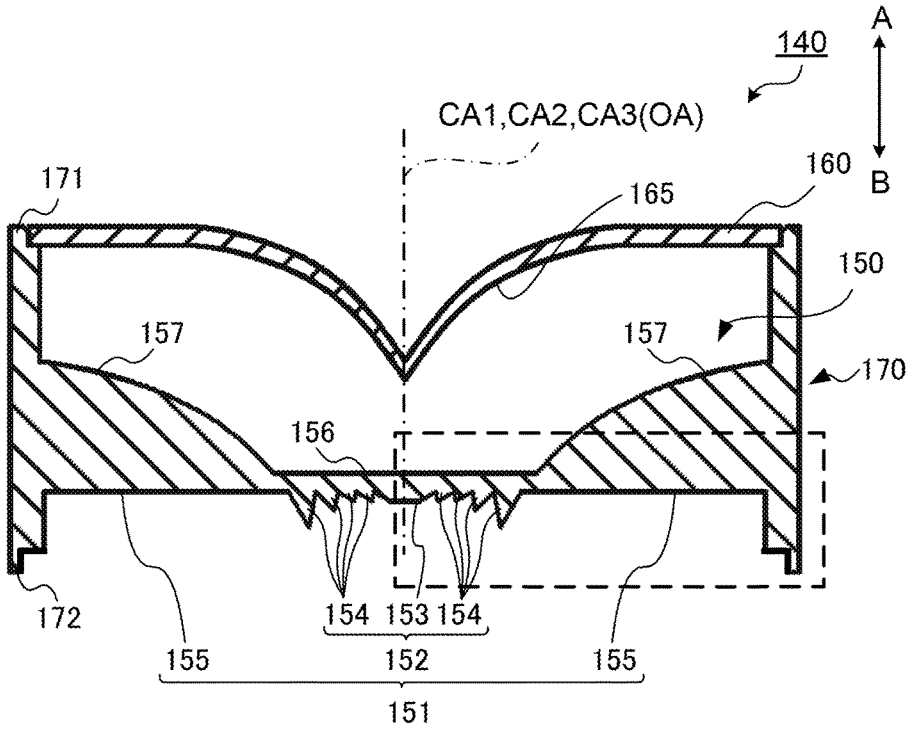
FIG. 4A is a sectional view illustrating a configuration of a light flux controlling member according to the embodiment.
Figure 4B:
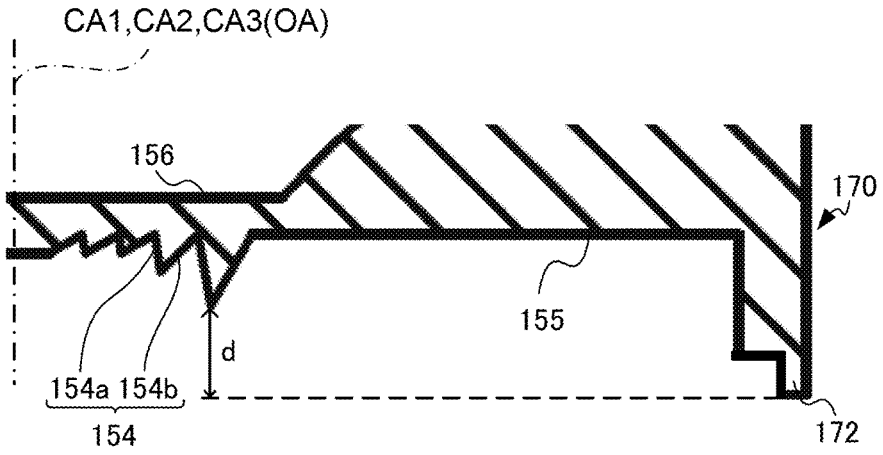
FIG. 4B is a partially enlarged sectional view of a region indicated with the broken line in FIG. 4A.

Next, a configuration of light flux controlling member 140 according to the present embodiment is described. FIG. 4A is a sectional view of light flux controlling member 140, and FIG. 4B is a partially enlarged sectional view of a region illustrated with the broken line in FIG. 4A.

As illustrated in FIG. 4A, light flux controlling member 140 includes first light flux controlling member 150, second light flux controlling member 160 and holder 170. In the present embodiment, first light flux controlling member 150 is integrally formed with holder 170. First light flux controlling member 150 is disposed inside holder 170 such that first light flux controlling member 150 can face light emitting element 130. The rear end part of holder 170 is fixed to substrate 125. Second light flux controlling member 160 is fixed to the front end part of holder 170 in such a manner as to close the front opening of holder 170 (to cover first light flux controlling member 150). Central axis CA1 of first light flux controlling member 150, central axis CA2 of second light flux controlling member 160, and central axis CA3 of holder 170 coincide with one another. In addition, in the present embodiment, central axes CA1, CA2 and CA3 are coincide with optical axis OA of the plurality of light emitting elements 130 (see FIG. 2). Further, in the present embodiment, in the plurality of light emitting elements 130, optical axis OA of light emitting element 130 disposed at the center of substrate 125 coincides with central axis CA1.

Figure 5A:
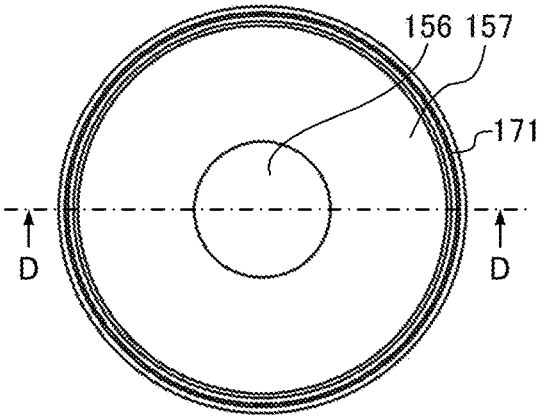
FIGS. 5A to 5D illustrate a configuration of a first light flux controlling member and a holder.
Figure 5B:
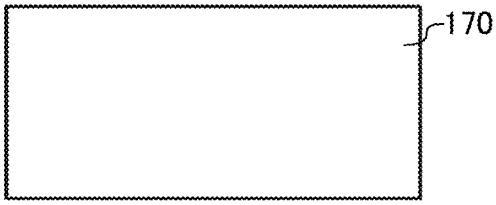
Figure 5D:
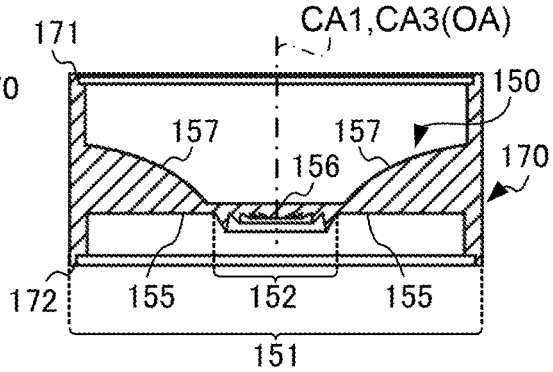
Figure 5C:
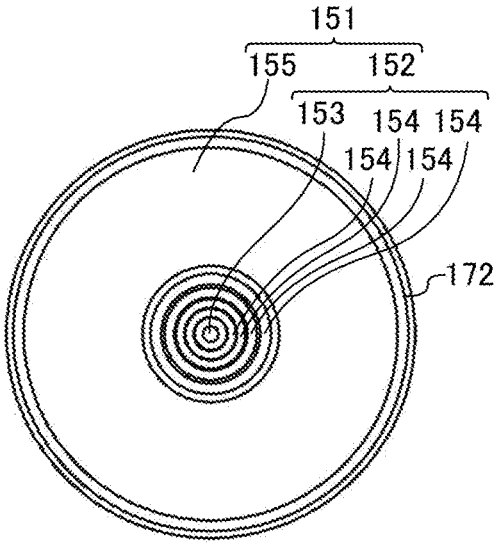

FIGS. 5A to 5D illustrate configurations of first light flux controlling member 150 and holder 170. FIG. 5A is a plan view of first light flux controlling member 150 and holder 170, FIG. 5B is a side view of first light flux controlling member 150 and holder 170, FIG. 5C is a bottom view of first light flux controlling member 150 and holder 170, and FIG. 5D is a sectional view taken along line D-D of FIG. 5A. As illustrated in FIG. 5A, first light flux controlling member 150 has a substantially circular shape in plan view. First light flux controlling member 150 is integrally formed with holder 170, and first light flux controlling member 150 is disposed such that an air layer is interposed between first light flux controlling member 150 and light emitting element 130 (see FIG. 2).

As illustrated in FIGS. 5A to 5D, first light flux controlling member 150 includes incidence region 151 on which the light emitted from light emitting element 130 is incident, emission surface 156 disposed on a side (forward side) opposite to incidence region 151 and configured to emit a part of light incident on incidence region 151 in a forward direction and a lateral direction, and reflecting surface 157 disposed outside emission surface 156 and configured to reflect another part of the light incident on incidence region 151 in a lateral direction and a rearward direction.

As illustrated in FIG. 4A, incidence region 151 allows the light emitted from light emitting element 130 to enter first light flux controlling member 150. Incidence region 151 is disposed on the rear side of first light flux controlling member 150. Incidence region 151 includes fresnel lens part 152 disposed at a center portion, and incidence surface 155 disposed outside fresnel lens part 152.

Mainly, fresnel lens part 152 allows a part of the light emitted from light emitting element 130 disposed at the center of substrate 125 (on central axis CA1 of first light flux controlling member 150) to enter first light flux controlling member 150, and reflects the incident light toward emission surface 156. Fresnel lens part 152 is disposed to intersect central axis CA1 (optical axis OA) of first light flux controlling member 150. In addition, a refracting surface for refracting the light emitted from light emitting element 130 may or may not be disposed at a center portion of fresnel lens part 152. In the present embodiment, refracting surface 153 is disposed inside fresnel lens part 152.

Mainly, refracting surface 153 allows a part of the light emitted from light emitting element 130 disposed at the center of substrate 125 (light emitted at a small angle with respect to optical axis OA) to enter first light flux controlling member 150, and refracts the incident light toward emission surface 156. As illustrated in FIG. 2, refracting surface 153 is disposed at a position opposite to light emitting element 130 disposed at the center of substrate 125 to intersect central axis CA1 (optical axis OA) of first light flux controlling member 150. Refracting surface 153 is composed of a surface rotationally symmetrical about central axis CA1. The shape of refracting surface 153 is not limited as long as the above-mentioned function can be obtained. The surface of refracting surface 153 has, for example, a planar shape, a spherical shape, an aspherical shape, a shape of a refractive fresnel lens, or a combination of these shapes. In the present embodiment, the surface of refracting surface 153 has a planar shape perpendicular to central axis CA1 of first light flux controlling member 150, and refracting surface 153 has a substantially circular shape in plan view.

Mainly, a plurality of projected lines 154 allow a part of the light emitted from light emitting element 130 disposed at the center of substrate 125 (light emitted at a relatively large angle with respect to optical axis OA) to enter first light flux controlling member 150, and reflect the incident light toward emission surface 156. Projected lines 154 are concentrically disposed outside refracting surface 153 such that a valley part is formed between adjacent two projected lines 154. The shape and the size of projected line 154 are not limited as long as the above-mentioned function can be obtained. In the present embodiment, projected line 154 has an annular shape. In addition, in a plane including central axis CA1 of first light flux controlling member 150, the cross-sectional areas of projected lines 154 may be identical to each other or different from each other. In the present embodiment, the sizes of projected lines 154 are different from each other. In addition, in the direction of optical axis OA (direction of central axis CA1), distance d between the rear end part of holder 170 and the tip end portion of each projected line 154 gradually decreases from the inside toward the outside as illustrated in FIG. 4B. In the following, the plane including the rear end part of holder 170 of light flux controlling member 140 is referred to as "reference surface."

As illustrated in FIG. 4B, projected line 154 includes first inclined surface 154*a* and second inclined surface 154*b*. In projected line 154, first inclined surface 154*a* is disposed on the inner side (a side closer to central axis CA1 of first light flux controlling member 150), and second inclined surface 154*b* is disposed on the outer side.

Mainly, first inclined surface 154*a* allows for incidence of a part of the light emitted from light emitting element 130 disposed at the center of substrate 125, and refracts the light to second inclined surface 154*b* side. First inclined surface 154*a* is a surface rotationally symmetrical about central axis CA1 of first light flux controlling member 150, and has an annular shape. First inclined surface 154*a* may be parallel to central axis CA1. Preferably, from the viewpoint of shaping of first light flux controlling member 150, first inclined surface 154*a* is slightly tilted with respect to central axis CA1. In this case, first inclined surface 154*a* is tilted such that the distance from central axis CA1 of first light flux controlling member 150 increases as the distance to the reference surface decreases. In projected lines 154, the inclination angles of first inclined surface 154*a* with respect to central axis CA1 may be identical to each other or different from each other. In the present embodiment, in projected lines 154, the inclination angles of first inclined surface 154*a* are different from each other. In addition, the generatrix of first inclined surface 154*a* may be a straight line, or a curved line. In the present embodiment, the generatrix of first inclined surface 154*a* is a straight line. It is to be noted that, while the term "generatrix" generally means a straight line that forms a ruled surface, the term "generatrix" used herein includes a curved line that forms a rotationally symmetrical surface. In addition, in the case where the generatrix of the inclined surface is a curved line, the "inclined angle of inclined surface" means the angle of the tangent to the inclined surface with respect to central axis CA1.

Second inclined surface 154*b* is formed to be paired with first inclined surface 154*a*, and reflects light incident on first inclined surface 154*a* toward emission surface 156. Second inclined surface 154*b* is a surface rotationally symmetrical about central axis CA1 of first light flux controlling member 150, and has an annular shape. Preferably, second inclined surface 154*b* is tilted with respect to central axis CA1 from the viewpoint of totally reflecting the arrival light. In this case, second inclined surface 154*b* is tilted such that the distance to central axis CA1 decreases as the distance to the reference surface decreases. In projected lines 154, the inclination angles of second inclined surface 154*b* with respect to central axis CA1 may be identical to each other or different from each other. In the present embodiment, in projected lines 154, the inclination angles of second inclined surface 154*b* are different from each other. In addition, the generatrix forming second inclined surface 154*b* may be a straight line, or a curved line. In the present embodiment, the generatrix of second inclined surface 154*b* is a straight line.

Incidence surface 155 is disposed on the outside of fresnel lens part 152. Mainly, incidence surface 155 allows a part of the light emitted from light emitting element 130 disposed on the outside in the plurality of light emitting elements 130 to enter first light flux controlling member 150, and refracts the incident light toward reflecting surface 157. The shape of the surface of incidence surface 155 may be a planar shape, or a curved shape. In addition, incidence surface 155 may or may not be perpendicular to central axis CA1 of first light flux controlling member 150. In the present embodiment, incidence surface 155 is a plane orthogonal to central axis CA1.

Emission surface 156 emits, toward second light flux controlling member 160, light incident on refracting surface 153 and light incident on first inclined surface 154*a* which is reflected by second inclined surface 154*b*. Emission surface 156 is disposed on the front side of first light flux controlling member 150 to face second light flux controlling member 160. The shape of emission surface 156 may be a planar shape, or a curved shape. In addition, emission surface 156 may or may not be perpendicular to central axis CA1 of first light flux controlling member 150. In the present embodiment, emission surface 156 is a plane perpendicular to central axis CA1.

Reflecting surface 157 reflects light incident on incidence surface 155. Reflecting surface 157 is disposed on the front side of first light flux controlling member 150 and on the outside of emission surface 156 to face second light flux controlling member 160. Reflecting surface 157 is a surface rotationally symmetrical about central axis CA1 of first light flux controlling member 150. The generatrix of reflecting surface 157 is formed as a curve recessed with respect to incidence surface 155 from the inner periphery portion to the outer periphery portion. In addition, the outer periphery portion of reflecting surface 157 is formed at a position (forward side) where the distance from incidence surface 155 in the direction of optical axis OA (central axis CA1 direction) is greater than that of the inner periphery portion. That is, reflecting surface 157 is a curved surface having an aspherical shape whose distance in the direction along optical axis OA from an orthogonal plane (for example, incidence surface 155) which is orthogonal to optical axis OA and passes through an arbitrary point on the incidence surface increases from the inner periphery portion toward the outer periphery portion. In this case, the angle of reflecting surface 157 with respect to central axis CA1 of first light flux controlling member 150 increases from the inner periphery portion toward the outer periphery portion.

The material of first light flux controlling member 150 is not limited as long as the material has a high transmissivity which allows light having desired wavelengths to pass therethrough. Examples of the material of first light flux controlling member 150 include light transmissive resins such as polymethylmethacrylate (PMMA), polycarbonate (PC), and epoxy resin (EP); and glass. First light flux controlling member 150 is formed by injection molding for example.

In addition, from the view point of totally reflecting light, a metal layer composed of silver, aluminum, gold, copper, or an alloy of these materials may be disposed on reflecting surface 157 of first light flux controlling member 150. The metal layer is formed by an evaporation method, or a sputtering method, for example.

Figure 6A:
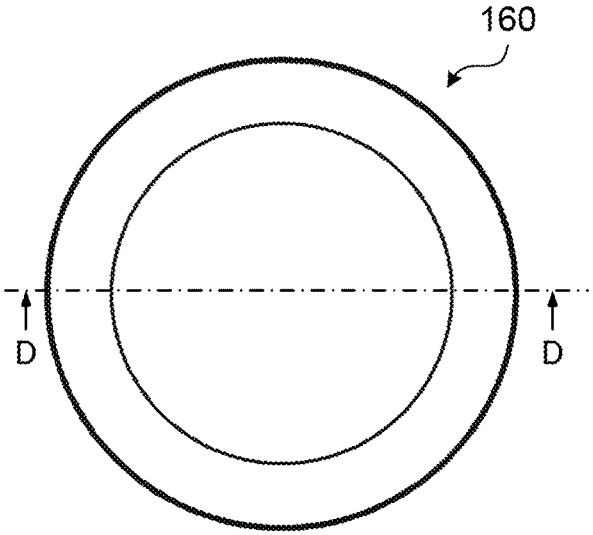
FIGS. 6A to 6D illustrate a configuration of a second light flux controlling member.
Figure 6B:
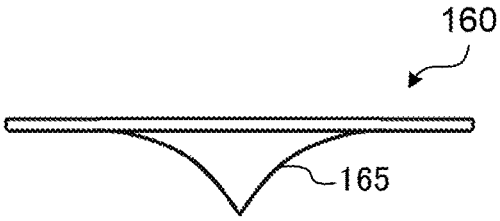
Figure 6D:
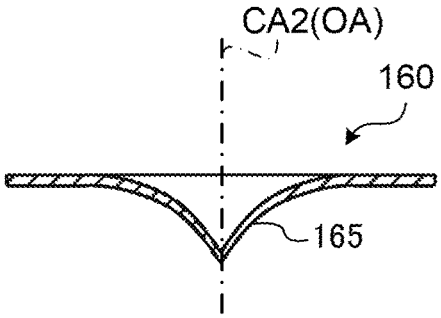
Figure 6C:
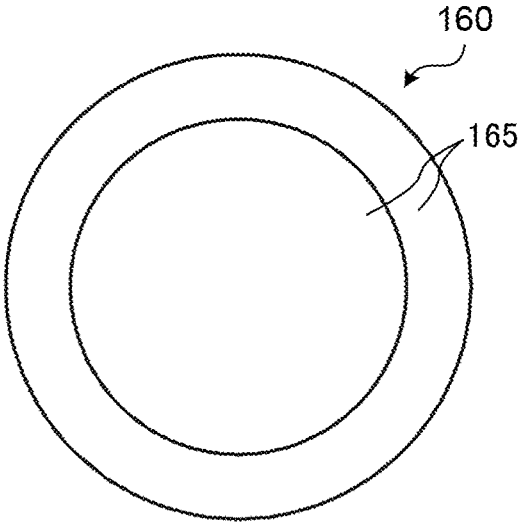

FIGS. 6A to 6D illustrate a configuration of second light flux controlling member 160. FIG. 6A is a plan view of second light flux controlling member 160, FIG. 6B is a side view of second light flux controlling member 160, FIG. 6C is a bottom view of second light flux controlling member 160, and FIG. 6D is a sectional view taken along line D-D of FIG. 6A.

Second light flux controlling member 160 allows a part of light arriving from first light flux controlling member 150 to pass therethrough in the forward direction and the lateral direction, and reflects the remaining part of the light in the lateral direction and the rearward direction. As illustrated in FIG. 6A, second light flux controlling member 160 has a substantially circular shape in plan view. Second light flux controlling member 160 is disposed such that an air layer is interposed between second light flux controlling member 160 and first light flux controlling member 150 (see FIG. 2). Second light flux controlling member 160 includes transmission reflecting surface 165 for achieving the above-mentioned function.

Transmission reflecting surface 165 allows a part of light emitted from emission surface 156 of first light flux controlling member 150 and arrived at second light flux controlling member 160 to pass therethrough, and reflects the remaining part of the light. Transmission reflecting surface 165 is disposed to face emission surface 156 and reflecting surface 157 of first light flux controlling member 150. Transmission reflecting surface 165 is a surface rotationally symmetrical about central axis CA2 of second light flux controlling member 160. The generatrix of transmission reflecting surface 165 is formed as a curve recessed with respect to first light flux controlling member 150 from the center to the outer periphery portion of the rotationally symmetrical surface. In addition, the outer periphery portion of transmission reflecting surface 165 is disposed at a position (forward side) where the distance from the above-described orthogonal plane (for example, incidence surface 155) in the direction along optical axis OA (central axis CA2) is greater than that of the center portion. That is, transmission reflecting surface 165 is a curved surface having an aspherical shape whose distance in the direction along optical axis OA from first light flux controlling member 150 increases from the center portion toward the outer periphery portion. In this case, the angle of transmission reflecting surface 165 to central axis CA2 of second light flux controlling member 160 increases from the center portion toward the outer periphery portion. It is to be noted that, preferably, the surface of second light flux controlling member 160 which faces first light flux controlling member 150 is formed as a glossy surface. In addition, transmission reflecting surface 165 may be integrally formed with second light flux controlling member 160, or may be formed as a separated member.

The way of giving the above-mentioned function to second light flux controlling member 160 is not limited. For example, the above-mentioned function can be given to second light flux controlling member 160 by forming second light flux controlling member 160 with a light transmissive material having a desired light transmittance. In this case, examples of the light transmissive material having a desired light transmittance include a resin, glass and the like. Examples of the light transmissive resin having a desired light transmittance include white resin such as acrylic resin and the like. By adjusting the light transmittance of the material of second light flux controlling member 160, the proportion of the emission light in each direction can be adjusted.

In addition, the above-mentioned function can be given to second light flux controlling member 160 also by disposing a transmissive reflection film on the surface of the rear side (the side closer to first light flux controlling member 150) of second light flux controlling member 160, for example. In this case, the material of second light flux controlling member 160 may be a material which does not reflect light. Second light flux controlling member 160 is composed of the above-mentioned materials for first light flux controlling member 150. Examples of the transmissive reflection film include: dielectric multi-layer films such as a multi-layer film composed of $TiO_2$ and $SiO_2$, a multi-layer film composed of $ZrO_2$ and $SiO_2$, and a multi-layer film composed of $Ta_2O_5$ and $SiO_2$; and a metal thin film composed of aluminum (Al), and the like.

In addition, the above-mentioned function can be given to second light flux controlling member 160 also by dispersing a scattering member such as beads in second light flux controlling member 160 composed of a material having light transmitting property. That is, second light flux controlling member 160 may be formed with a material which allows a part of arriving light to pass therethrough while reflecting the remaining part of the arriving light.

Further, the above-mentioned function can be given to second light flux controlling member 160 also by forming a light transmitting part in second light flux controlling member 160 composed of a light reflective material. Examples of the light reflective material include white resins and metals. Examples of the light transmitting part include a through hole and a bottomed recess. In the latter case, light emitted from first light flux controlling member 150 passes through the bottom of the recess (the portion having a small thickness). For example, it is possible to produce second light flux controlling member 160 having light reflectivity and light transmitting property by use of white polymethylmethacrylate whose light transmittance and light reflectance for visible light are about 20% and about 80%, respectively.

Holder 170 holds first light flux controlling member 150 and second light flux controlling member 160. Holder 170 is fixed to substrate 125 at the rear end part thereof, and fixes first light flux controlling member 150 and second light flux controlling member 160 at predetermined positions with respect to light emitting element 130 on substrate 125. As illustrated in FIGS. 5A to 5D, holder 170 has a substantially cylindrical shape whose rotation axis is central axis CA3 of holder 170. Holder 170 may be integrally formed with first light flux controlling member 150, or may be formed as a separated member. In the present embodiment, holder 170 is integrally formed with first light flux controlling member 150 disposed at a center portion thereof.

Holder 170 includes a structure for fixing second light flux controlling member 160 at the front end part thereof. In addition, holder 170 includes a structure for fixation on substrate 125 at the rear end part thereof. For example, holder 170 includes front guide protrusion 171 at the front end part thereof, and rear guide protrusion 172 at the rear end part thereof.

The shape and the number of front guide protrusion 171 are not limited as long as second light flux controlling member 160 can be fixed to holder 170. As illustrated in FIG. 5A and FIG. 5D, in the present embodiment, front guide protrusion 171 has an annular shape formed over the whole circumference at the front end part of holder 170. It is to be noted that front guide protrusion 171 may be divided into multiple parts.

The shape and the number of rear guide protrusion 172 are not limited as long as holder 170 can be fixed to substrate 125. As illustrated in FIG. 5C and FIG. 5D, in the present embodiment, rear guide protrusion 172 has an annular shape formed over the whole circumference at the rear end part of holder 170. It is to be noted that rear guide protrusion 172 may be divided into multiple parts.

Holder 170 has light transmitting property. The material of holder 170 is not limited as long as light having a desired wavelength can pass therethrough. For example, holder 170 is composed of the above-mentioned materials for first light flux controlling member 150.

It is to be noted that holder 170 may have a light diffusion function. To give a light diffusion function to holder 170, a diffusing member may be added to holder 170, or light diffusion treatment may be applied on the surface of holder 170.

Light flux controlling member 140 can be manufactured by mounting second light flux controlling member 160 to an integrally formed article of first light flux controlling member 150 and holder 170. The integrally formed article of first light flux controlling member 150 and holder 170 can be manufactured by injection molding with a colorless and transparent resin material, for example. Second light flux controlling member 160 can be manufactured by injection molding with a white resin material, for example. Alternatively, second light flux controlling member 160 can be manufactured by forming a transmissive reflection film by depositing on a surface as transmission reflecting surface 165 after performing injection molding with a colorless and transparent resin material.

Second light flux controlling member 160 is fixed to the front end part of holder 170. The way of fixing second light flux controlling member 160 to holder 170 fix is not limited. Second light flux controlling member 160 can be fixed to holder 170 with an adhesive agent or the like, for example. With this configuration, front guide protrusion 171 prevents second light flux controlling member 160 from moving in the radial direction of holder 170.

Light flux controlling member 140 is fixed to substrate 125 through the rear end part of holder 170. The way of fixing light flux controlling member 140 on substrate 125 is not limited. Light flux controlling member 140 can be fixed on substrate 125 with an adhesive agent or the like, for example. With this configuration, rear guide protrusion 172 prevents light flux controlling member 140 from moving in the radial direction of holder 170. Thus, holder 170 is fixed at a predetermined position of housing 110, and first light flux controlling member 150 and second light flux controlling member 160 can be fixed at predetermined positions with respect to light emitting element 130.

In addition, light flux controlling member 140 may be formed by separately shaping first light flux controlling member 150 and holder 170, and by mounting first light flux controlling member 150 and second light flux controlling member 160 to holder 170. By separately shaping first light flux controlling member 150 and holder 170, the material can be more freely selected when shaping holder 170 and first light flux controlling member 150. For example, it is possible to easily perform shaping of holder 170 with a light transmissive material containing a scattering member, and shaping of first light flux controlling member 150 with a light transmissive material not containing a scattering member.

(Light Distribution Characteristics of Light-Emitting Device)

Next, the light distribution characteristics of light-emitting device 120 according to the present embodiment are described. First, the light path of the light emitted from light emitting element 130 in light flux controlling member 140 is described. In the following description, the emission direction of light is described as follows. When the direction of optical axis OA is 0°, the direction of 0° to 60° is "forward direction," the direction greater than 60° and 120° or smaller is "lateral direction," and the direction greater than 120° and 180° or smaller is "rearward direction."

First, the light emitted from light emitting element 130 disposed at the center of substrate 125 (on central axes CA1, CA2 and CA3 of light flux controlling member 140) is described. In the light emitted from light emitting element 130 disposed at the center of substrate 125, light having a small angle to optical axis OA enters first light flux controlling member 150 from refracting surface 153, and is emitted from emission surface 156 toward second light flux controlling member 160. Thereafter, the emission light reaches second light flux controlling member 160. In addition, in the light emitted from light emitting element 130 disposed at the center of substrate 125, light having a large angle to optical axis OA enters first light flux controlling member 150 from first inclined surface 154*a* of fresnel lens part 152, and is reflected by second inclined surface 154*b*, and, is emitted from emission surface 156 toward second light flux controlling member 160. Thereafter, the emission light reaches second light flux controlling member 160. Further, in the light emitted from light emitting element 130 disposed at the center of substrate 125, light having a further large angle to optical axis OA enters first light flux controlling member 150 from incidence surface 155 disposed outside fresnel lens part 152, and is refracted toward reflecting surface 157, and, reaches reflecting surface 157.

Next, the light emitted from light emitting elements 130 disposed on the outside, in the plurality of light emitting elements 130, is described. A part of the light emitted from light emitting elements 130 disposed on the outside enters first light flux controlling member 150 from incidence surface 155, and is refracted toward reflecting surface 157, and, reaches reflecting surface 157. In addition, another part of the light emitted from light emitting elements 130 disposed on the outside enters first light flux controlling member 150 from fresnel lens part 152 and is emitted from emission surface 156 toward second light flux controlling member 160. Thereafter, the emission light reaches second light flux controlling member 160.

A part of the light arriving at reflecting surface 157 is reflected in the lateral direction and the rearward direction at light reflecting surface 157. The light reflected in the lateral direction and the rearward direction at reflecting surface 157 passes through holder 170, and reaches a lateral portion and a lower portion of cover 180. At this time, reflecting surface 157 distributes the light such that, as the distance of the incident position of the arriving light on reflecting surface 157 to the inner periphery portion decreases, the emission light in the lateral direction and the emission light in the rearward direction are more directed to the forward side. In addition, reflecting surface 157 distributes the light such that, as the distance of the incident position of the arriving light on reflecting surface 157 to the outer periphery portion decreases, the emission light in the lateral direction and the emission light in the rearward direction are more directed toward the rearward side. In addition, another part of the light arriving at reflecting surface 157 is emitted toward second light flux controlling member 160 from reflecting surface 157. Thereafter, the emission light reaches second light flux controlling member 160.

A part of the light arriving at second light flux controlling member 160 passes through light transmission reflecting surface 165 and is emitted in the forward direction and the lateral direction. This emission light reaches a lateral portion and an upper portion of cover 180. In addition, another part of the light arriving at second light flux controlling member 160 is reflected by transmission reflecting surface 165 and is emitted in the lateral direction and the rearward direction. This emission light passes through holder 170, and reaches a lateral portion and a lower portion of cover 180. At this time, transmission reflecting surface 165 distributes the light such that, as the distance of the incident position of the arriving light on transmission reflecting surface 165 to the center thereof decreases, the emission light in the lateral direction and the emission light in the rearward direction are more directed to the forward side. In addition, transmission reflecting surface 165 distributes the light such that, as the distance to the outer periphery portion thereof of the incident position of the arriving light on transmission reflecting surface 165 decreases, the emission light in the lateral direction and the emission light in the rearward direction are more directed toward the rearward side. In addition, first light flux controlling member 150 can efficiently condense at a position on the side nearer to central axis CA2 of second light flux controlling member 160 the light emitted from light emitting element 130 disposed at the center with fresnel lens part 152. Thus, light flux controlling member 140 can increase the proportions of the emission light emitted in the lateral direction and the emission light in the rearward direction which are directed to the forward side.

In light-emitting device 120 according to the present embodiment, the emission light in the forward direction mainly includes light having passed through transmission reflecting surface 165 of second light flux controlling member 160. In addition, the emission light in the rearward direction mainly includes light reflected by reflecting surface 157 of first light flux controlling member 150 and light reflected by transmission reflecting surface 165 of second light flux controlling member 160. Further, the emission light in the lateral direction mainly includes light having passed through transmission reflecting surface 165 of second light flux controlling member 160, light reflected by transmission reflecting surface 165 of second light flux controlling member 160, and light reflected by reflecting surface 157 of first light flux controlling member 150. Accordingly, by adjusting the shape of reflecting surface 157 of first light flux controlling member 150, and the shape and the transmittance of transmission reflecting surface 165 of second light flux controlling member 160, the balance of the emission light in each direction can be adjusted.

(Simulation 1)

To confirm the effect of light flux controlling member 140 according to the present embodiment (in particular, the effect of first light flux controlling member 150), the light distribution characteristics were simulated with illumination device 100 according to the embodiment. In addition, for comparison, the light distribution characteristics were simulated with an illumination device (hereinafter also referred to as "illumination device according to comparative example 1") provided with no light flux controlling member 140, and an illumination device (hereinafter also referred to as "illumination device according to comparative example 2") provided with light flux controlling member 140' including fresnel lens part 152' disposed in such a manner as to cover all light emitting elements 130. In addition, five light emitting elements 130 are disposed on substrate 125 also in the illumination devices according to comparative example 1 and comparative example 2 (see FIG. 3). In this simulation, the illuminance obtained when all of five light emitting elements 130 are turned on was calculated, on the circumference of a circle which is formed when a virtual sphere distanced by 1000 mm from light emitting element 130 disposed at the center of substrate 125, and a virtual plane including the centers of three light emitting elements 130 disposed on the diameter of virtual circle C and extending along the direction of optical axis OA of the light emitting elements 130 intersect with each other.

Figure 7:
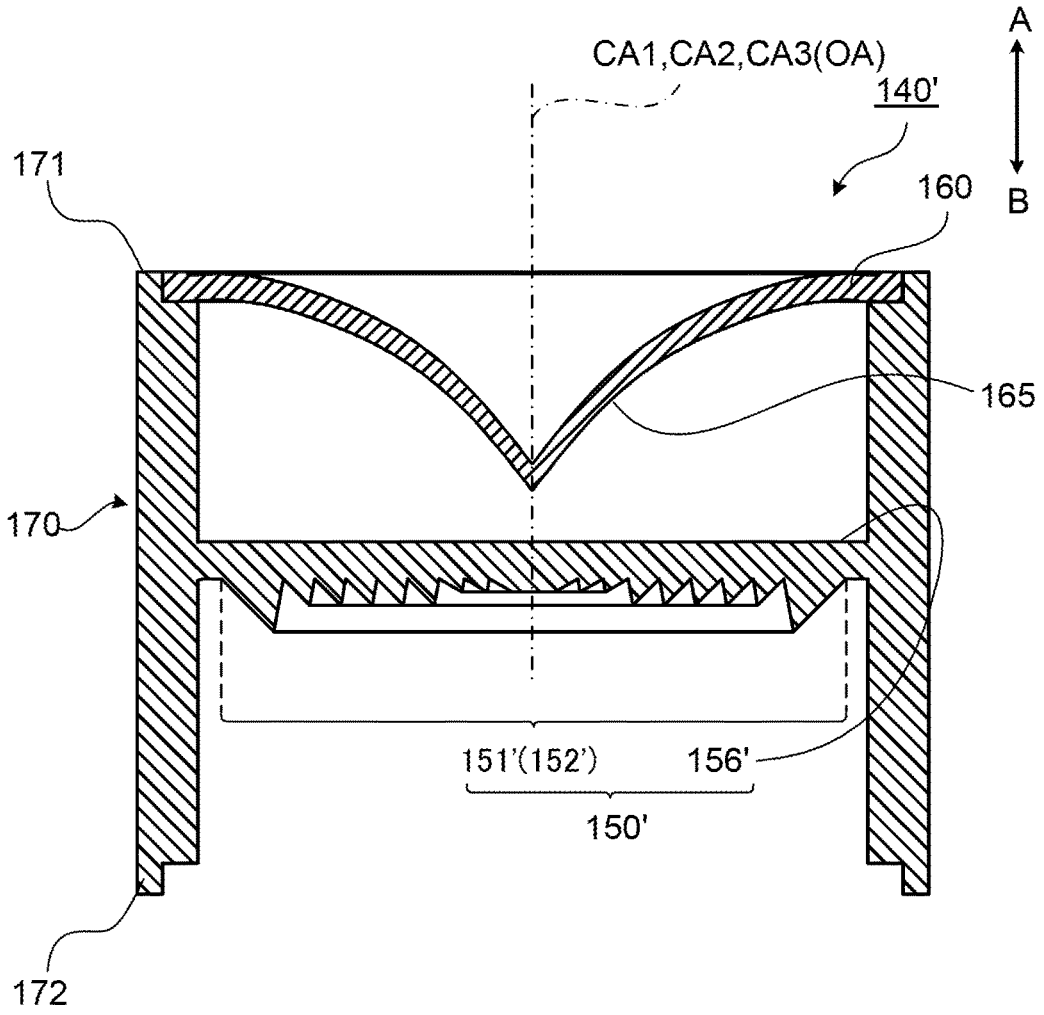
FIG. 7 is a sectional view illustrating a configuration of a light flux controlling member according to comparative example 2.

FIG. 7 is a sectional view illustrating a configuration of light flux controlling member 140' of the illumination device according to comparative example 2. Light flux controlling member 140' includes first light flux controlling member 150', second light flux controlling member 160 and holder 170. First light flux controlling member 150' includes incidence region 151' on which the light emitted from light emitting element 130 is incident, and emission surface 156' configured to emit the incident light toward the second light flux controlling member 160. Incidence region 151' is not provided with incidence surface 155, and is composed only of fresnel lens part 152'. In addition, in light flux controlling member 140 according to the present embodiment, fresnel lens part 152 is disposed in such a manner as to cover only light emitting element 130 disposed at the center of substrate 125. In contrast, in light flux controlling member 140' according to comparative example 2, fresnel lens part 152' is disposed in such a manner as to cover all of (five) light emitting elements 130 disposed on substrate 125.

Figure 8:
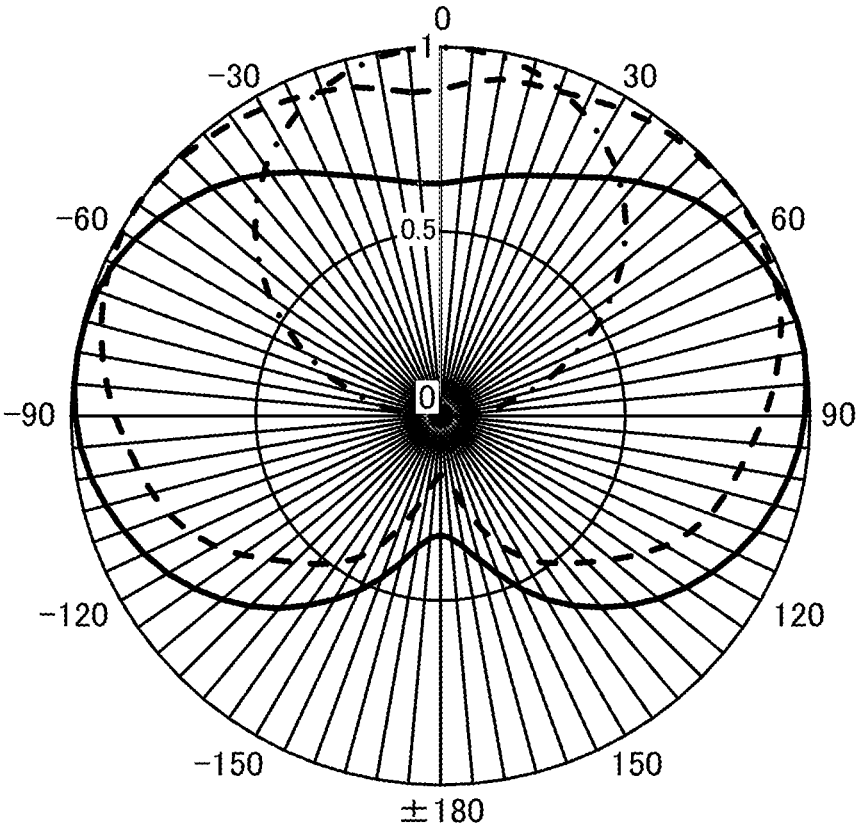
FIG. 8 is a graph showing simulations of the light distribution characteristics of illumination devices of comparative example 1, comparative example 2 and the embodiment.

FIG. 8 is a graph showing a simulation of the light distribution characteristics of the illumination device according to comparative example 1, the illumination device according to comparative example 2 and illumination device 100 according to the present embodiment. In FIG. 8, the dashed line indicates a result obtained with the illumination device according to comparative example 1, the broken line indicates a result obtained with the illumination device according to comparative example 2, and the solid line indicates a result obtained with illumination device 100 according to the embodiment. In addition, the numerical values shown around the graph indicate the angles to optical axis OA of light emitting elements 130 (central axes CA1, CA2 and CA3). In addition, the numerical values shown on the inside of the graph represent the relative illuminances (maximum value 1) of respective directions.

As the dashed line indicates in FIG. 8, the illumination device according to comparative example 1 mainly emits light in the forward direction (−60° to +60°). As the broken line indicates in FIG. 8, the illumination device according to comparative example 2 emits light in the forward direction, the lateral direction (−120° to −60°, +60° to +120°), and the rearward direction (−180° to −120°, +120° to +180°). As the solid line indicates in FIG. 8, illumination device 100 according to the embodiment also emits light in the forward direction, the lateral direction and the rearward direction. It was confirmed that, in illumination device 100 according to the embodiment, the proportion of the emission light in the forward direction is small, and the proportion of the emission light in the lateral direction and the rearward direction is large in comparison with the illumination device according to comparative example 2.

The illumination device according to comparative example 1 is provided with no light flux controlling member. Accordingly, the light distribution of the emission light in the forward direction from light emitting element 130 is not controlled, and the light is emitted in the forward direction without change. From the comparison between the illumination device according to comparative example 1, the illumination device according to comparative example 2 and illumination device 100 according to the embodiment, it can be said that light flux controlling members 140' and 140 contribute to distribution of the emission light from light emitting element 130 in the forward direction to the lateral direction and the rearward direction.

In addition, first light flux controlling member 150' of the illumination device according to comparative example 2 is not provided with incidence surface 155 and reflecting surface 157. In the illumination device according to comparative example 2, the light emitted in the forward direction, the lateral direction and the rearward direction are more directed toward the forward side, in comparison with illumination device 100 according to the embodiment. In view of this, it can be said that reflecting surface 157 of first light flux controlling member 150 according to the present embodiment contributes to distribution of the light emitted from light emitting element 130 to the rearward side.

(Simulation 2)

Next, to confirm the effect of light flux controlling member 140 according to the present embodiment (in particular, the effect of second light flux controlling member 160), the light distribution characteristics were simulated with illumination device 100 in which cover 180 is dismounted. In addition, for comparison, the light distribution characteristics were simulated also with an illumination device (hereinafter also referred to as "illumination device according to comparative example 3") in which cover 180 is dismounted, and second light flux controlling member 160 is not provided. Here, the simulation was conducted for the case where all of five light emitting elements 130 are turned on, the case where only light emitting element 130 disposed at the center in three light emitting elements 130 on the virtual plane (light emitting element 130 disposed at the center of substrate 125) is turned on, and the case where only one light emitting element 130 of two light emitting elements 130 disposed on the outside on the virtual plane is turned on. This simulation was conducted under the condition identical to that of simulation 1 except for the difference of the illumination devices.

Figure 9A:
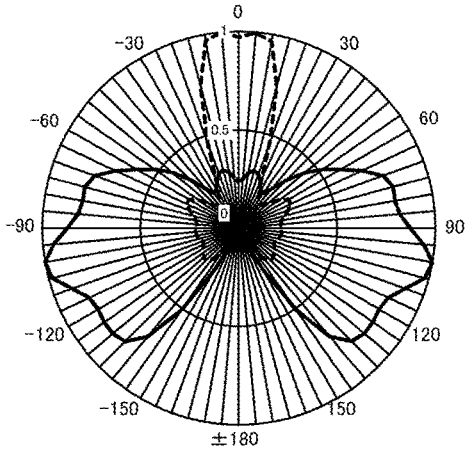
FIGS. 9A to 9C are graphs showing simulations of light distribution characteristics with an illumination device according to comparative example 3 and the illumination device of the embodiment in which a holder is dismounted.
Figure 9B:
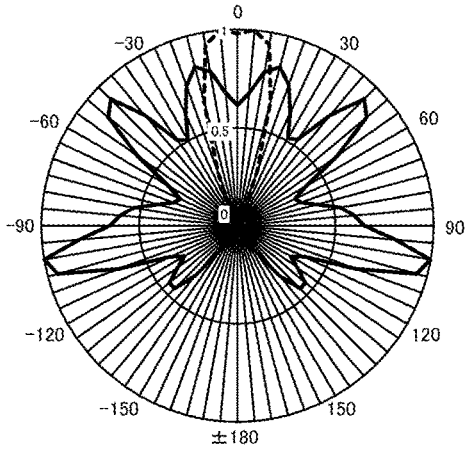
Figure 9C:
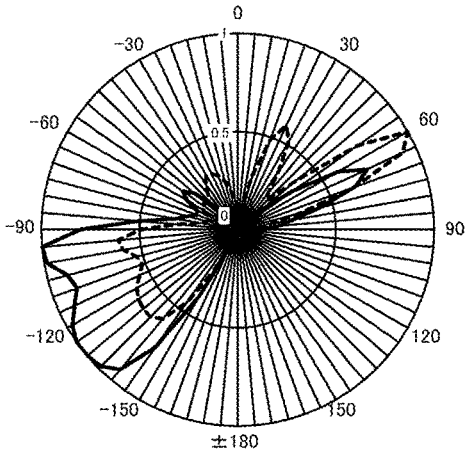

FIGS. 9A to 9C are graphs showing simulations of the light distribution characteristics of the illumination device according to comparative example 3 and illumination device 100 in which cover 180 is dismounted. FIG. 9A is a graph showing a simulation of the case where all of five light emitting elements 130 are turned on, FIG. 9B is a graph showing a simulation of the case where only light emitting element 130 disposed at the center of three light emitting elements 130 on the virtual plane (only light emitting element 130 disposed at the center of substrate 125) is turned on, and FIG. 9C is a graph showing a simulation of the case where only one light emitting element 130 of two light emitting elements 130 disposed on the outside on the virtual plane is turned on. In FIGS. 9A to 9C, the broken line indicates a result obtained with the illumination device according to comparative example 3, and the solid line indicates a result obtained with illumination device 100 in which cover 180 is dismounted.

First, the simulation of the case where all of five light emitting elements 130 are turned on is described. As the broken line indicates in FIG. 9A, it can be said that, in the illumination device according to comparative example 3, the proportion of the emission light in the forward direction (−15° to +15°) is large, and the proportion of the emission light in the lateral direction and the rearward direction is extremely small. On the other hand, it can be said that, as the solid line indicates in FIG. 9A, in illumination device 100 provided with no cover 180, the proportion of the emission light in the forward direction (−15° to +15°) is small, and the proportion of the emission light in the lateral direction and the rearward direction (−145° to −70°, +70° to +140°) is large in comparison with the illumination device according to comparative example 3. It can be said from this result that second light flux controlling member 160 contributes to distribution of the emission light in the forward direction (−15° to +15° direction) from first light flux controlling member 150, to the lateral direction and the rearward direction (−145° to −70°, +70° to +140°). In addition, it can be said that second light flux controlling member 160 allows a part of emission light in the forward direction (−15° to +15°) to pass therethrough.

Next, a simulation of the case where only light emitting element 130 disposed at the center of three light emitting elements 130 on the virtual plane (light emitting element 130 disposed at the center of substrate 125) is turned on is described. As the broken line indicates in FIG. 9B, it can be said that, in the illumination device according to comparative example 3, the proportion of the emission light in the lateral direction and the rearward direction is extremely small, and the proportion of the emission light in the forward direction (−15° to +15°) is extremely large. In view of this, it can be said that fresnel lens part 152 of first light flux controlling member 150 efficiently condenses the light emitted from light emitting element 130 disposed at the center of substrate 125 to the side nearer to central axis CA2 of second light flux controlling member 160. On the other hand, it can be said that, as the solid line indicates in FIG. 9B, in illumination device 100 in which cover 180 is dismounted, the proportion of the emission light in the forward direction (−10° to +10°) is small, and the proportions of the emission light in the forward direction (±15°, ±45°), the lateral direction (±100°) and the rearward direction (±130°) which are directed toward the rearward side are large in comparison with the case of the illumination device according to comparative example 3. It can be said from this result that second light flux controlling member 160 contributes to distribution of the light emitted from light emitting element 130 disposed at the center of substrate 125 and arriving at second light flux controlling member 160, to the forward direction (±15°, ±45°), the lateral direction (±100°) and the rearward direction (±130°) which are directed toward the rearward direction side. In addition, it can be said that second light flux controlling member 160 allows a part of emission light in the forward direction (−15° to +15°) to pass therethrough.

Next, a simulation of the case where only one light emitting element 130 of two light emitting elements 130 disposed on the outside on the virtual plane is turned on is described. In the graph of FIG. 9C, of two light emitting elements 130 disposed on the outside on the virtual plane, the direction of light emitting element 130 which is turned on is disposed is negative (−) direction, and the opposite direction is positive (+) direction. As the broken line indicates in FIG. 9C, it can be said that, the illumination device according to comparative example 3, the proportion of the emission light in the forward direction (+25°, +55° to +65°) and the lateral direction and the rearward direction (−135° to −95°) is large. On the other hand, as the solid line indicates in FIG. 9C, it can be said that in illumination device 100 in which cover 180 is dismounted, the proportion of the emission light in the forward direction (+25°, +55° to +60°) is small, and the proportion of the emission light toward in the lateral direction and the rearward direction (−95° to −135° direction) is large in comparison with the illumination device according to comparative example 3. It can be said from this result that second light flux controlling member 160 also contributes to emission of the light emitted from light emitting elements 130 disposed on the outside, in the lateral direction and the rearward direction. In addition, it can be said that second light flux controlling member 160 allows a part of emission light in the lateral direction (+65°) to pass therethrough.

(Effect)

Light flux controlling member 140 according to the present embodiment can condense the light emitted from light emitting element 130 disposed at the center of substrate 125 (on central axes CA1. CA2 and CA3 of light flux controlling member 140) to the side nearer to central axis CA2 of second light flux controlling member 160 with fresnel lens part 152 of first light flux controlling member 150. Light flux controlling member 140 can emit the light emitted from light emitting element 130 disposed at the center of substrate 125 in the forward direction, the lateral direction and the rearward direction with second light flux controlling member 160. In addition, light flux controlling member 140 can reflect the light emitted from light emitting element 130 disposed at the center of substrate 125 in the lateral direction and the rearward direction with reflecting surface 157. That is, light flux controlling member 140 can appropriately control the light distribution of the light emitted from light emitting element 130 disposed on central axes CA1. CA2 and CA3.

In addition, light flux controlling member 140 can reflect the light emitted from light emitting element 130 disposed on the outer side of substrate 125 in the lateral direction and the rearward direction with reflecting surface 157. In addition, light flux controlling member 140 can emit the light emitted from light emitting element 130 disposed on the outer side of substrate 125 in the forward direction, the lateral direction and the rearward direction with second light flux controlling member 160. That is, light flux controlling member 140 can appropriately control the light distribution of the light emitted from light emitting element 130 disposed on the outer side, in the plurality of light emitting elements 130.

As a result, illumination device 100 provided with light flux controlling member 140 according to the present embodiment can distribute with a good balance the light emitted from light emitting element 130 disposed on central axes CA1, CA2 and CA3 of light flux controlling member 140, and the light emitted from light emitting elements 130 disposed on the outer side, to the forward direction, the lateral direction and the rearward direction. Accordingly, illumination device 100 provided with light flux controlling member 140 according to the present embodiment can be used equivalently to an incandescent lamp.

Figure 10:
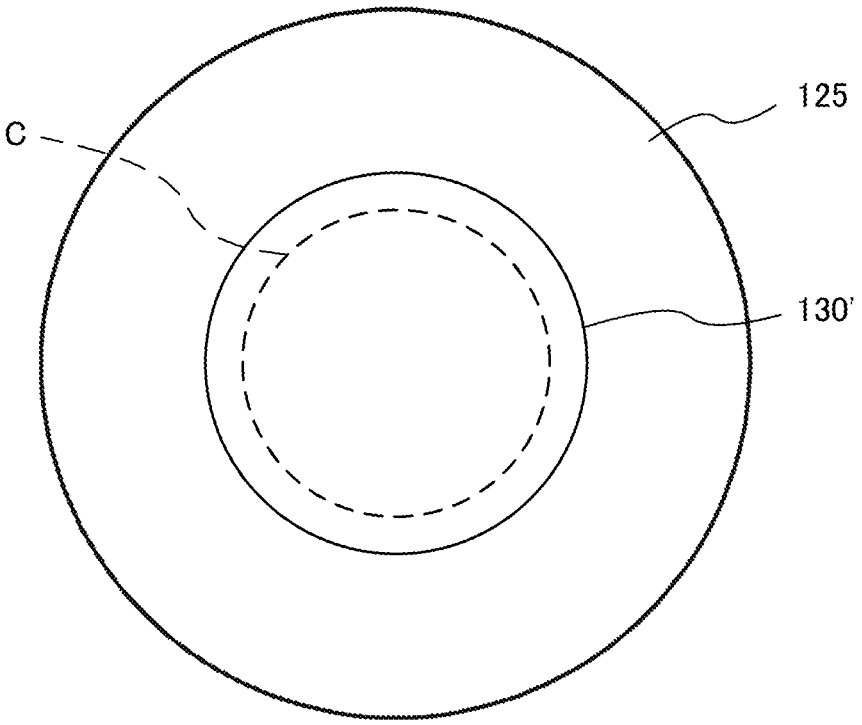
FIG. 10 illustrates an example of installation positions of the light emitting elements on a substrate.

One light emitting element 130 is disposed at the center of virtual circle C on substrate 125, and four light emitting elements 130 are disposed at even intervals on the circumference of virtual circle C in light-emitting device 120 and illumination device 100 as illustrated in FIG. 3 in the above-mentioned embodiment. Alternatively, in the light-emitting device and the illumination device according to the embodiment of the present invention, one light emitting element 130' having a large size may be disposed on substrate 125 all over the region where five light emitting elements 130 are disposed in above-mentioned embodiment. For example, as illustrated in FIG. 10, one light emitting element 130' in which the light emitting surface is disposed to include the entirety of the inner portion of virtual circle C may be disposed on substrate 125. In this case, one light emitting element 130' is disposed at a position facing a part of the incidence surface and the fresnel lens part. At this time, preferably, the optical axis that is the center of the total light flux of light emitting element 130' coincides with the central axis of the first light flux controlling member from the viewpoint of emitting light with a good balance.

This application is entitled to and claims the benefit of Japanese Patent Application No. 2014-144066 filed on Jul. 14, 2014, the disclosure each of which including the specification, drawings and abstract is incorporated herein by reference in its entirety.

INDUSTRIAL APPLICABILITY

The illumination device including the light flux controlling member according to the embodiment of the present invention can be used in place of an incandescent lamp, and therefore can be widely applied to illumination devices such as a chandelier and an indirect lighting device.

REFERENCE SIGNS LIST

10 LED module
20 Lens
21 Incidence surface
22 Emission surface
100 Illumination device
110 Housing
111 Base
112 Housing main body
120 Light-emitting device
125 Substrate
130, 130' Light emitting element
140, 140' Light flux controlling member
150, 150' First light flux controlling member
151, 151' Incidence region
152, 152' Fresnel lens part
153 Refracting surface

154 Projected line
154*a* First inclined surface
154*b* Second inclined surface
155 Incidence surface
156, 156' Emission surface
157 Reflecting surface
160 Second light flux controlling member
165 Transmission reflecting surface
170 Holder
171 Front guide protrusion
172 Rear guide protrusion
180 Cover
C Virtual circle
CA1 Central axis of first light flux controlling member
CA2 Central axis of second light flux controlling member
CA3 Central axis of holder
OA Optical axis of light emitting element

The invention claimed is:

1. A light flux controlling member configured to control a distribution of light emitted from at least one light emitting element, the light flux controlling member comprising:

a first light flux controlling member including:

an incidence region on which light emitted from the light emitting element is incident, the incidence region including a fresnel lens part disposed to surround a central axis of the first light flux controlling member and an incidence surface disposed on an outside of the fresnel lens part, an emission surface from which a part of light incident on the incidence region is emitted, the emission surface being disposed on a side opposite to the incidence region, and a reflecting surface configured to reflect another part of the incident light, the reflecting surface being disposed on an outside of the emission surface; and a second light flux controlling member including a transmission reflecting surface disposed at a position facing the emission surface and the reflecting surface, the transmission reflecting surface being configured to allow a part of arriving light emitted from the emission surface to pass therethrough while reflecting a remaining part of the arriving light, wherein:

the reflecting surface is rotationally symmetrical about the central axis of the first light flux controlling member and is formed such that a generatrix of the reflecting surface is a curve recessed with respect to the incidence surface, and that a distance of an outer periphery portion thereof from an orthogonal plane that is orthogonal to an optical axis and passes through an arbitrary point on the incidence surface in a direction along the optical axis is larger than that of an inner periphery portion thereof, the optical axis being a center of a total light flux of the light emitting element, and the transmission reflecting surface is rotationally symmetrical about a central axis of the second light flux controlling member, and is formed such that a generatrix of the transmission reflecting surface is a curve recessed with respect to the first light flux controlling member, and that a distance of an outer periphery portion thereof from the orthogonal plane in the direction along the optical axis is larger than that of a center portion thereof.

2. The light flux controlling member according to claim 1 wherein the incidence surface is a plane.

3. A light-emitting device comprising:

a substrate;

at least one light emitting element disposed on the substrate; and the light flux controlling member according to claim 1 or 2 disposed over the light emitting element, wherein:

the light emitting element is disposed at a position facing a part of the incidence surface and at least a part of the fresnel lens part.

4. The light-emitting device according to claim 3, wherein the number of the light emitting element is one.

5. The light-emitting device according to claim 3, wherein a plurality of the light emitting elements are provided.

6. The light-emitting device according to claim 3, wherein the optical axis that is the center of the total light flux of the light emitting element coincides with the central axis of the first light flux controlling member.

7. The light-emitting device according to claim 5, wherein:

an optical axis of one light emitting element of the plurality of the light emitting elements coincides with the central axis of the first light flux controlling member; and at least one light emitting element of the plurality of the light emitting elements other than the light emitting element whose optical axis coincides with the central axis of the first light flux controlling member is disposed to overlap an internal edge of the reflecting surface as viewed from the second light flux controlling member side.

8. An illumination device comprising:

the light-emitting device according to claim 3;

a cover configured to cover the light flux controlling member and allow light emitted from the light-emitting device to pass therethrough while diffusing the light; and a housing configured to support the light-emitting device and the cover.

9. A light-emitting device comprising:

a substrate;

at least one light emitting element disposed on the substrate; and the light flux controlling member according to claim 2 disposed over the light emitting element, wherein:

the light emitting element is disposed at a position facing a part of the incidence surface and at least a part of the fresnel lens part.

10. The light-emitting device according to claim 9, wherein the number of the light emitting element is one.

11. The light-emitting device according to claim 9, wherein a plurality of the light emitting elements are provided.

12. The light-emitting device according to claim 4, wherein the optical axis that is the center of the total light flux of the light emitting element coincides with the central axis of the first light flux controlling member.

13. The light-emitting device according to claim 5, wherein the optical axis that is the center of the total light flux of the light emitting element coincides with the central axis of the first light flux controlling member.

14. The light-emitting device according to claim 9, wherein the optical axis that is the center of the total light flux of the light emitting element coincides with the central axis of the first light flux controlling member.

15. The light-emitting device according to claim 10, wherein the optical axis that is the center of the total light flux of the light emitting element coincides with the central axis of the first light flux controlling member.

16. The light-emitting device according to claim 11, wherein the optical axis that is the center of the total light flux of the light emitting element coincides with the central axis of the first light flux controlling member.

17. The light-emitting device according to claim 11, wherein:

an optical axis of one light emitting element of the plurality of the light emitting elements coincides with the central axis of the first light flux controlling member; and at least one light emitting element of the plurality of the light emitting elements other than the light emitting element whose optical axis coincides with the central axis of the first light flux controlling member is disposed to overlap an internal edge of the reflecting surface as viewed from the second light flux controlling member side.

18. An illumination device comprising:

the light-emitting device according to claim 9;

a cover configured to cover the light flux controlling member and allow light emitted from the light-emitting device to pass therethrough while diffusing the light; and a housing configured to support the light-emitting device and the cover.

* * * * *